US011169474B2

(12) United States Patent
Kim

(10) Patent No.: US 11,169,474 B2
(45) Date of Patent: Nov. 9, 2021

(54) VAPOR CHAMBER BASED STRUCTURE FOR COOLING PRINTING MEDIA PROCESSED BY FUSER

(71) Applicant: HEWLETT-PACKARD DEVELOPMENT COMPANY, L.P., Spring, TX (US)

(72) Inventor: Jong-Oh Kim, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/044,511

(22) PCT Filed: Nov. 27, 2018

(86) PCT No.: PCT/KR2018/014678
§ 371 (c)(1),
(2) Date: Oct. 1, 2020

(87) PCT Pub. No.: WO2019/245116
PCT Pub. Date: Dec. 26, 2019

(65) Prior Publication Data

US 2021/0109465 A1 Apr. 15, 2021

(30) Foreign Application Priority Data

Jun. 18, 2018 (KR) ..... 10-2018-0069810

(51) Int. Cl.
*G03G 15/20* (2006.01)
*F28D 15/02* (2006.01)
*G03G 21/20* (2006.01)

(52) U.S. Cl.
CPC ..... *G03G 15/2017* (2013.01); *F28D 15/0233* (2013.01); *F28D 15/0266* (2013.01);
(Continued)

(58) Field of Classification Search
CPC ..... G03G 15/2017; G03G 15/6573; G03G 21/20; G03G 21/206; G03G 2215/00805;
(Continued)

(56) References Cited

U.S. PATENT DOCUMENTS 4,542,980 A * 9/1985 Tajima ..... G03G 15/2007 219/216
4,545,671 A * 10/1985 Anderson ..... G03G 15/6529 399/341

(Continued)

FOREIGN PATENT DOCUMENTS

JP 06258904 A * 9/1994
JP 2003-091189 3/2003

(Continued)

*Primary Examiner* — Robert B Beatty
(74) *Attorney, Agent, or Firm* — Staas & Halsey LLP

(57) ABSTRACT

A printer includes a printing unit to form a toner image on a printing medium, a fuser to apply heat and pressure to the printing medium that has passed through the printing unit to fuse the toner image on the printing medium, and a liquid-vapor chamber having a length in a width direction of the printing medium greater than a width of the printing medium. The liquid-vapor chamber has a heat absorber side to face the printing medium to absorb heat from the printing medium, a condenser side apart from the heat absorber side in an opposite direction not facing the printing medium to form an inner space between the condenser side and the heat absorber side, and a working fluid sealed in the inner space and to undergo a liquid-vapor phase change by moving between the heat absorber side and the condenser side, to absorb heat from the printing medium to cool the printing medium that has passed through the fuser.

15 Claims, 7 Drawing Sheets

(52) U.S. Cl.
CPC .. *B65H 2301/5144* (2013.01); *B65H 2801/03* (2013.01); *G03G 21/206* (2013.01)

(58) Field of Classification Search
CPC .... G03G 2221/1645; B65H 2301/5144; B65H 2801/03; B65H 2801/06; F28D 15/02; F28D 15/0233; F28D 15/0266; F28D 15/04
USPC ..... 399/92, 94, 341; 219/216
See application file for complete search history.

(56) References Cited

U.S. PATENT DOCUMENTS 5,076,351 A * 12/1991 Munekawa ..... F28D 15/0283 165/104.21
5,512,924 A * 4/1996 Takada ..... B41J 2/04563 347/18
5,596,397 A * 1/1997 Shimada ..... F28D 15/02 219/469
9,713,285 B2 * 7/2017 Cader ..... G06F 1/206
2010/0132922 A1 6/2010 Meyer, IV et al.
2011/0232877 A1 9/2011 Meyer, IV et al.
2012/0315069 A1 * 12/2012 Ikeda ..... G03G 15/2017 399/341
2012/0328344 A1 12/2012 Kunii et al.
2014/0016973 A1 1/2014 Begeal
2017/0123373 A1 * 5/2017 Ogino ..... G03G 21/206
2019/0390918 A1 * 12/2019 Hirasawa ..... H05K 7/20336
2020/0340756 A1 * 10/2020 Lin ..... F28D 15/0283

FOREIGN PATENT DOCUMENTS

JP 2012168216 A * 9/2012
JP 2014174356 9/2014
JP 2016040620 3/2016
KR 2011-0011717 2/2011
WO WO-2011149216 12/2011

* cited by examiner

[Fig. 1]
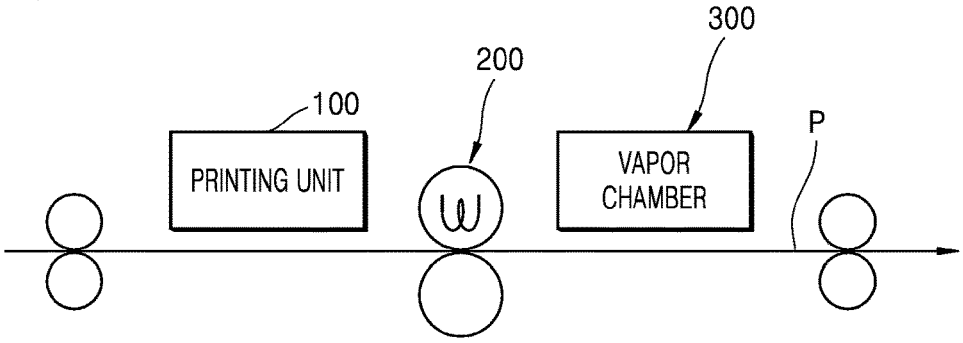
[Fig. 2]
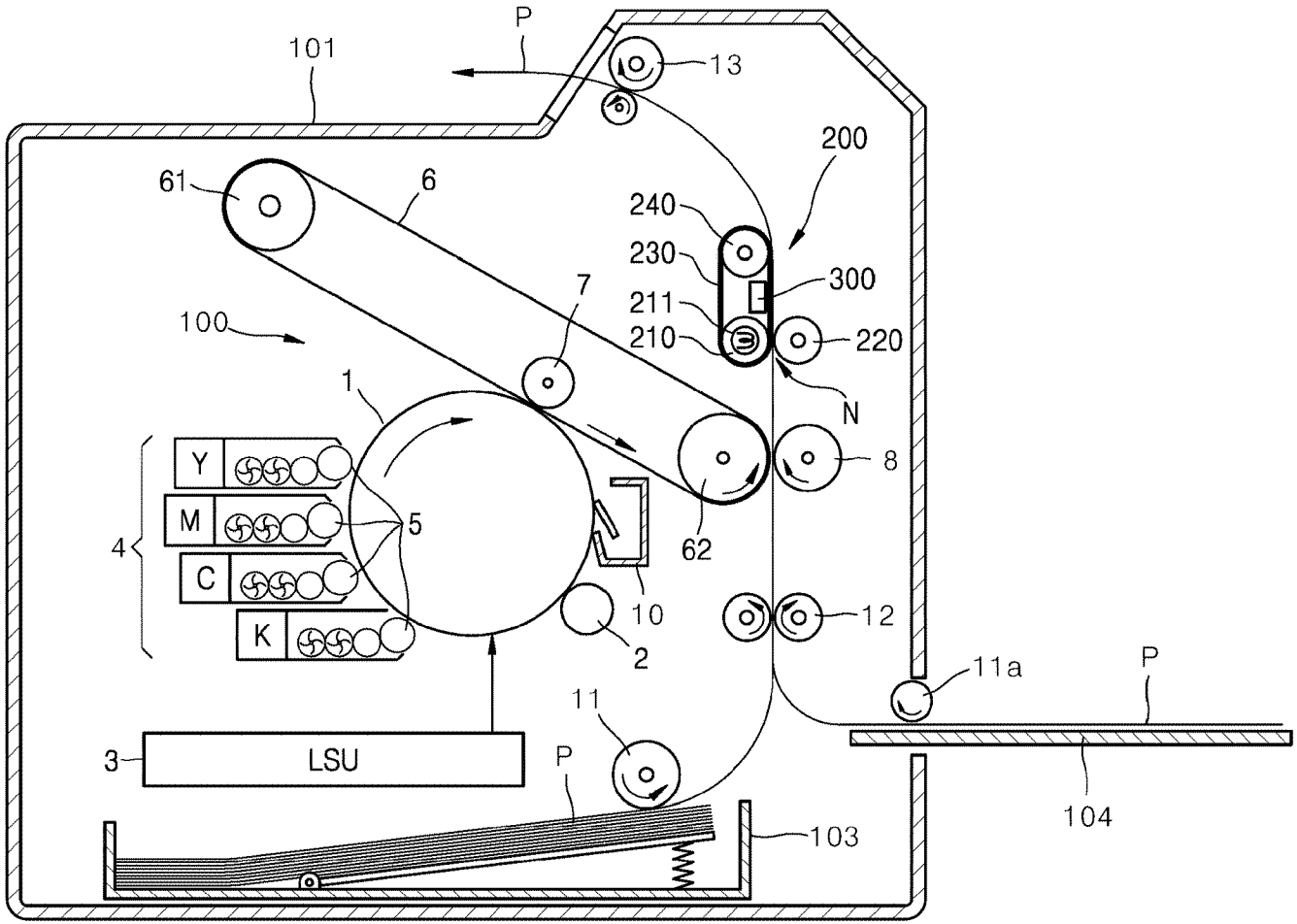

[Fig. 3]
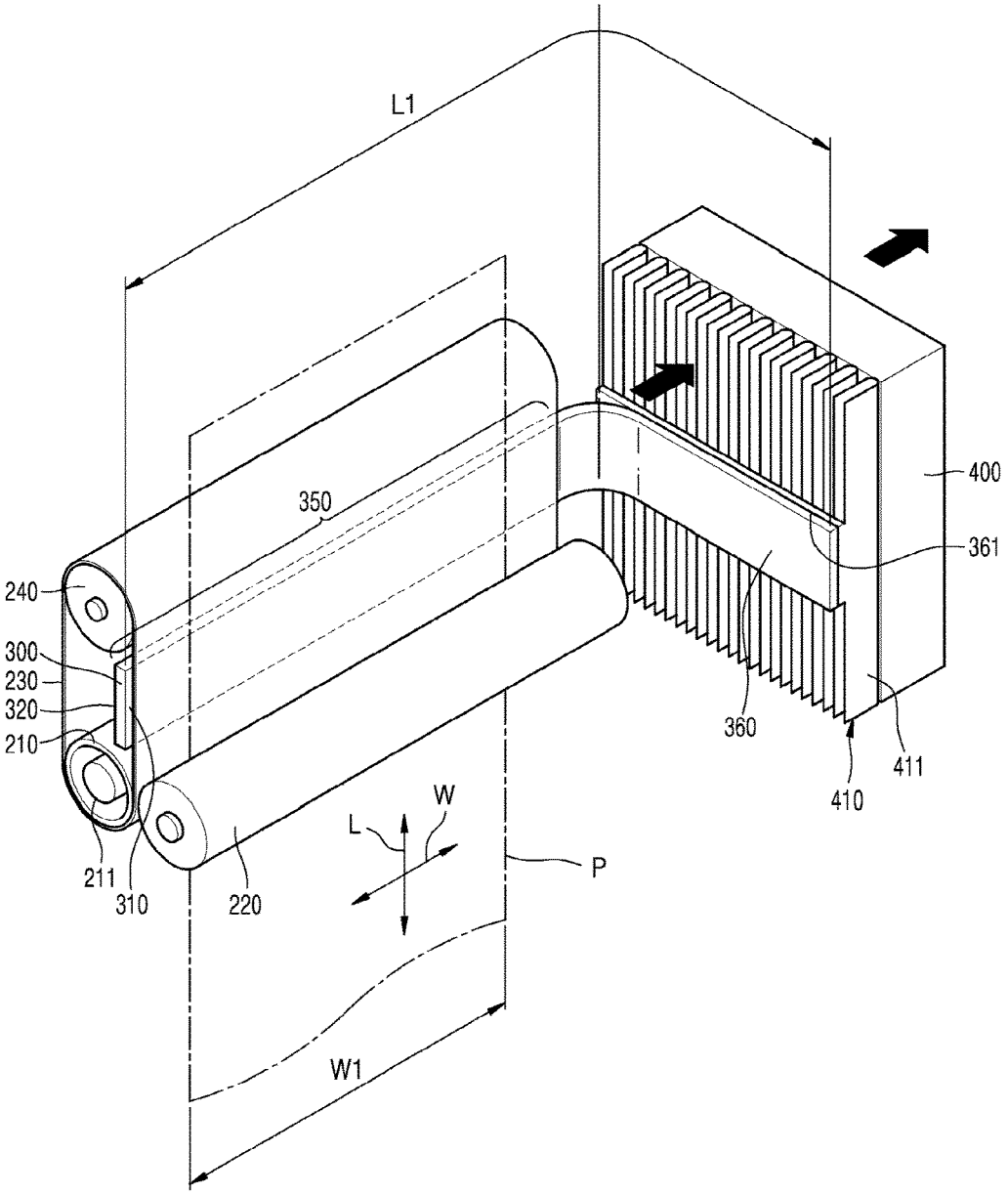
[Fig. 4]
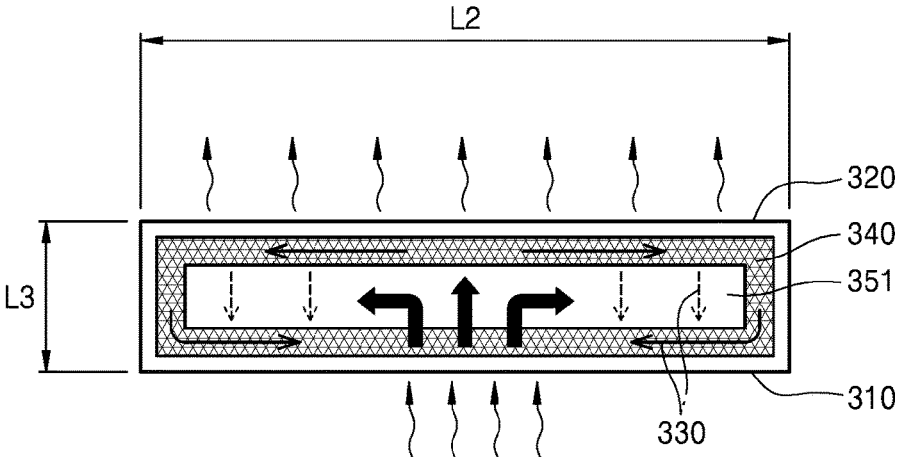

[Fig. 5]
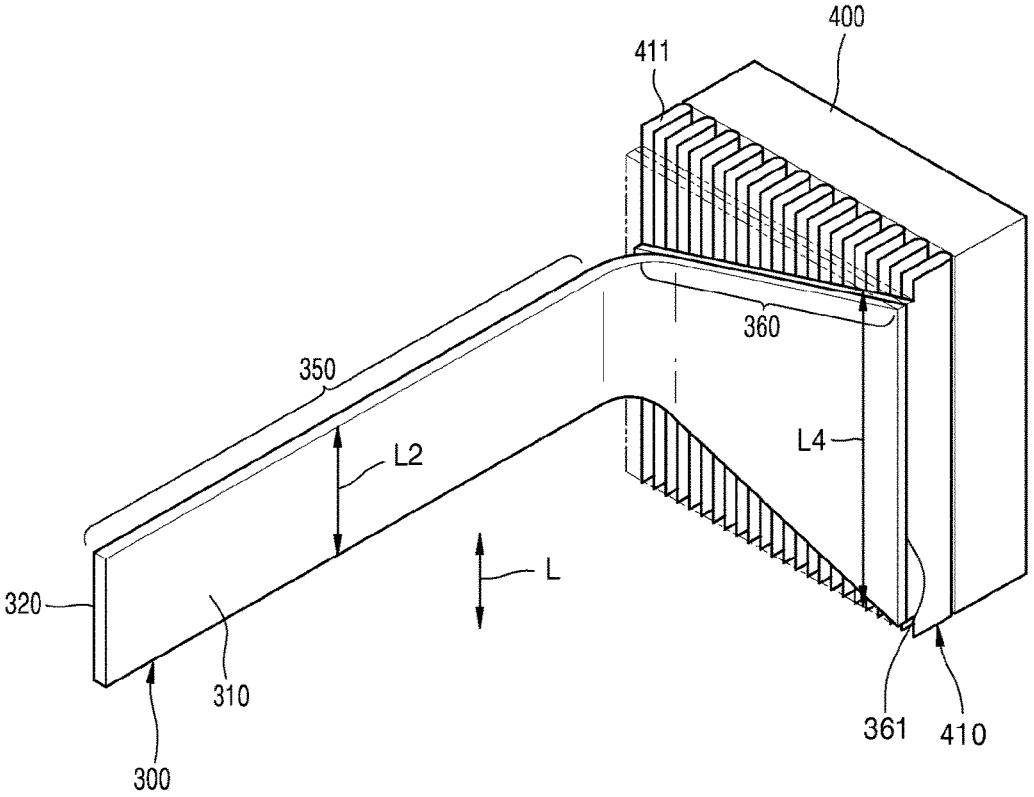
[Fig. 6]
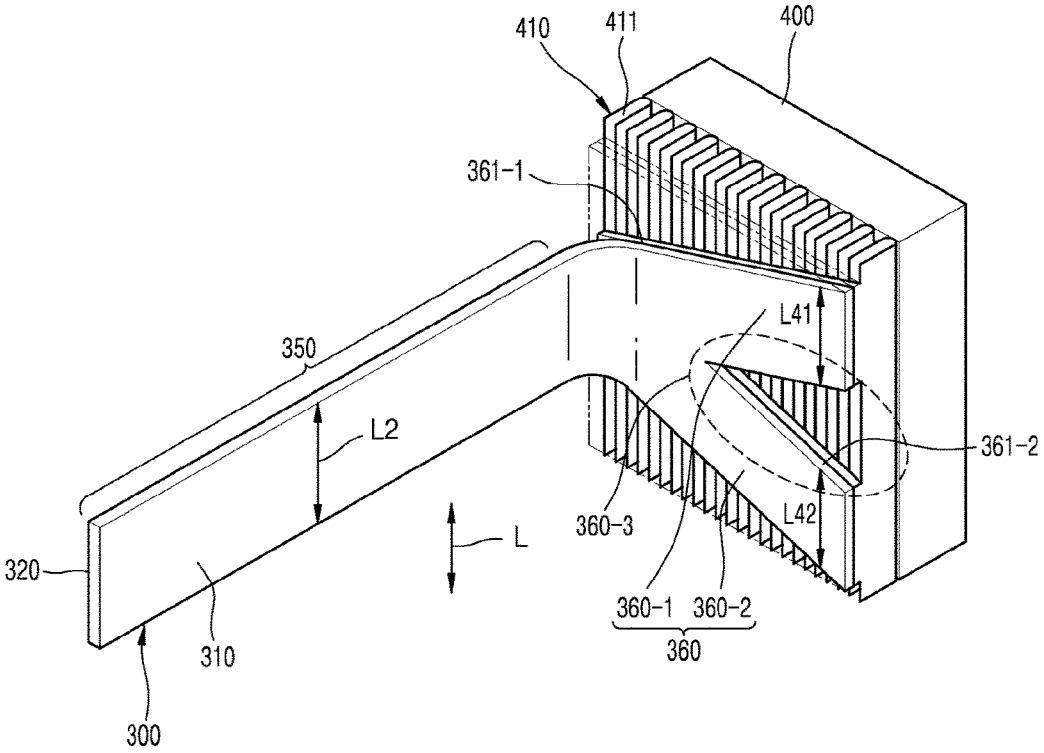

[Fig. 7]
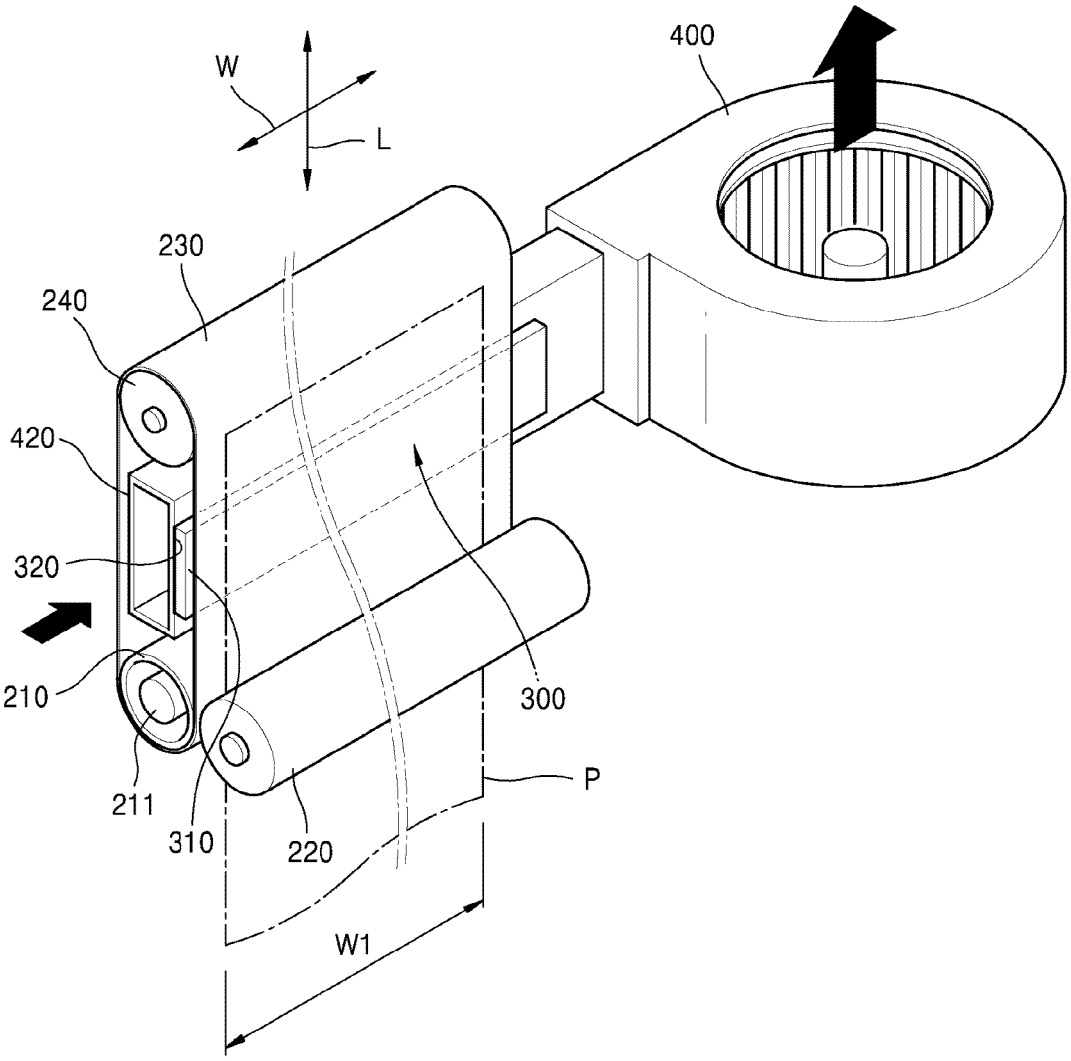

[Fig. 8]
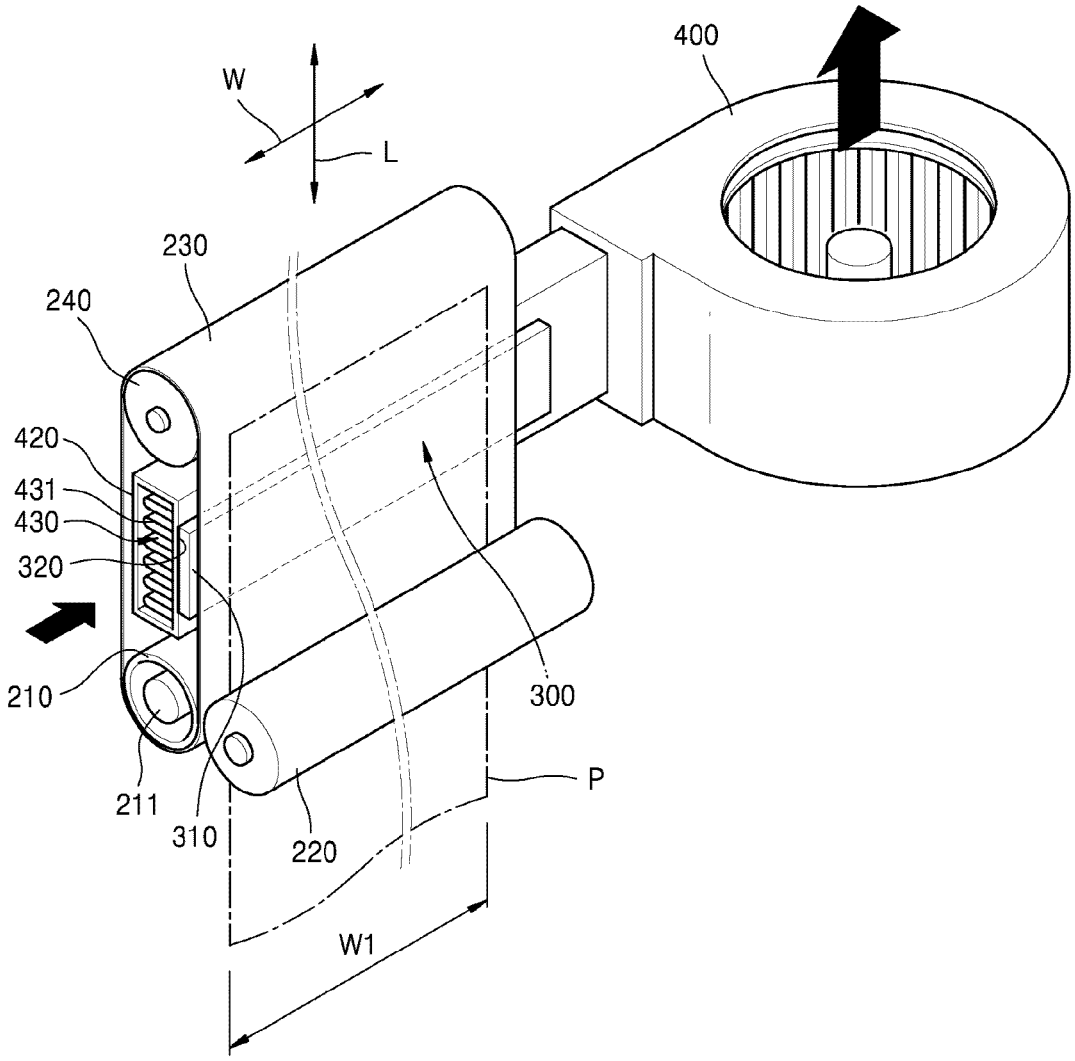

[Fig. 9]
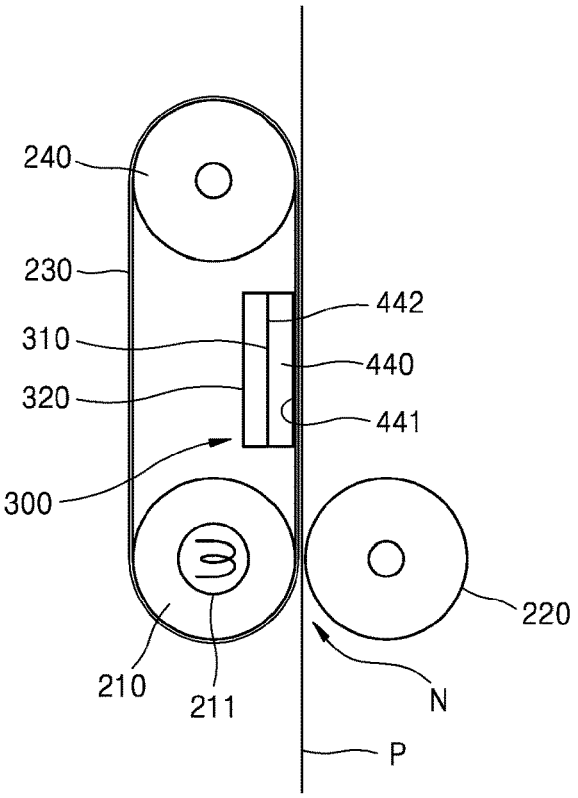
[Fig. 10]
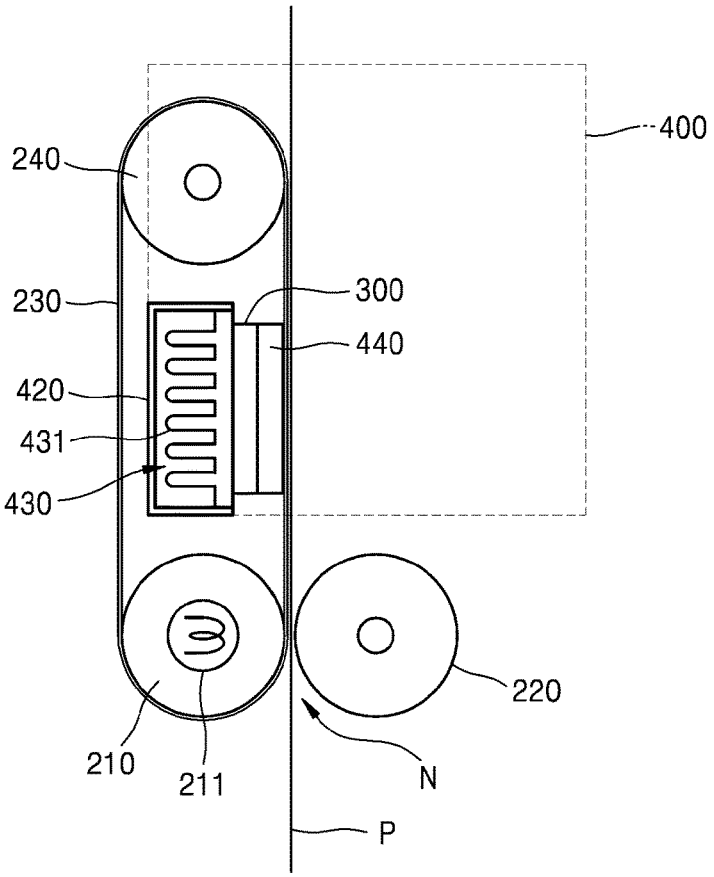

[Fig. 11]
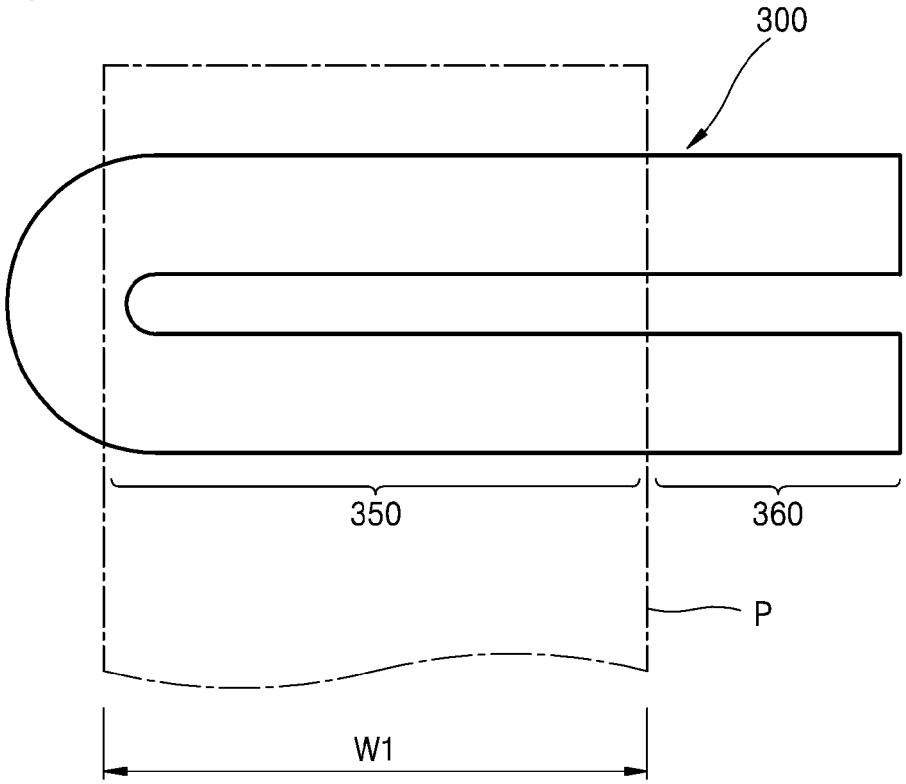
[Fig. 12]
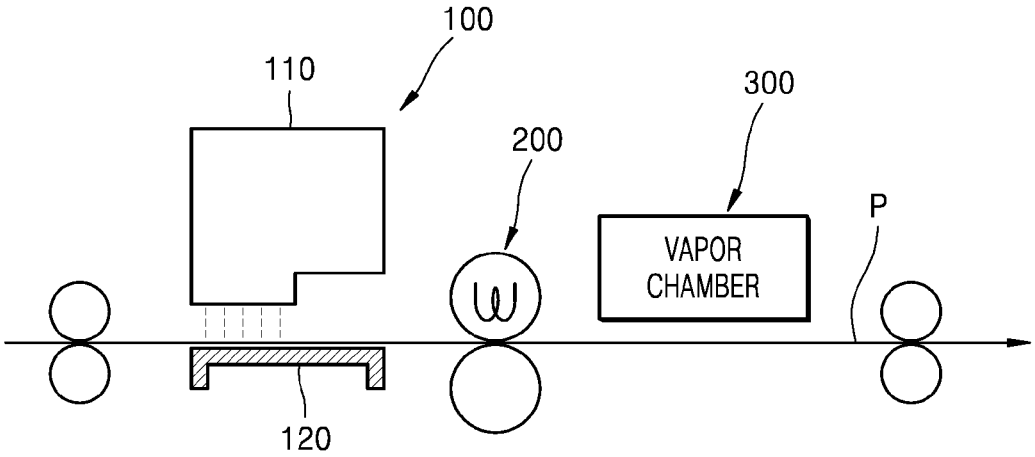

VAPOR CHAMBER BASED STRUCTURE FOR COOLING PRINTING MEDIA PROCESSED BY FUSER

CROSS REFERENCE TO RELATED APPLICATIONS

This application is filed under 35 U.S.C. § 371 as a National Stage of PCT International Application No. PCT/KR2018/014678, filed on Nov. 27, 2018, in the Korean Intellectual Property Office, which claims the priority benefit of Korean Patent Application No. 10-2018-0069810, filed on Jun. 18, 2018, in the Korean Intellectual Property Office. The disclosures of PCT International Application No. PCT/KR2018/014678 and Korean Patent Application No. 10-2018-0069810 are incorporated by reference herein in their entireties.

BACKGROUND ART

An electrophotographic printer forms an electrostatic latent image on a photoreceptor by scanning light on the photoreceptor charged with a uniform potential, and forms a toner image on the photoreceptor by supplying toner to the electrostatic latent image. The toner image is then transferred directly to a printing medium or through an intermediate transfer belt. The toner image transferred to the printing medium is attached to the printing medium by an electrostatic force. A fuser applies heat and pressure to the toner image to fuse the toner image onto the printing medium as a permanent image.

BRIEF DESCRIPTION OF DRAWINGS

FIG. 1 is a schematic configuration diagram of an example of a printer;

FIG. 2 is a configuration diagram of an example of an electrophotographic printer;

FIG. 3 is a perspective view of an example of a cooling structure for cooling a printing medium;

FIG. 4 is a cross-sectional view of an example of a vapor chamber;

FIG. 5 is a perspective view showing an example of a heat dissipation structure;

FIG. 6 is a perspective view showing an example of a heat dissipation structure;

FIG. 7 is a perspective view showing an example of a heat dissipation structure;

FIG. 8 is a perspective view showing an example of a heat dissipation structure;

FIG. 9 is a side view of an example of a cooling structure for cooling a printing medium;

FIG. 10 is a side view of an example of a cooling structure for cooling a printing medium;

FIG. 11 is a plan view of an example of a vapor chamber; and

FIG. 12 is a schematic configuration diagram of an example of an ink jet printer.

MODE FOR THE INVENTION

After fusing, the printing medium has a high temperature due to heat received during the fusing process. Cooling the printing medium after fusing increases glossiness of the permanent image printed on the printing medium. Due to the increased glossiness, the same effect as in the case of a photographic image may be obtained. Although a blower is employed in a printer, it is difficult to cool the printing medium to such an extent that glossiness is increased by using the blower.

FIG. 1 is a schematic configuration diagram of an example of a printer. Referring to FIG. 1, the printer may include a printing unit 100 forming an image on a printing medium P, a fuser 200 applying heat and pressure to the printing medium P processed by the printing unit 100 and fusing the image on the printing medium P, and a vapor chamber (a liquid-vapor chamber) 300 cooling the printing medium P processed by the fuser 200. The printing unit 100 may form the image on the printing medium P by using various printing methods.

FIG. 2 is a configuration diagram of an example of an electrophotographic printer. Referring to FIG. 2, the printing unit 100 of the present example forms a toner image on the printing medium P by using an electrophotographic method. The printing unit 100 of the present example transfers a color toner image to the printing medium P by using a multipass method. For example, the printing unit 100 may include a photosensitive drum 1, a charging roller 2, an exposure device 3, a developing device 4, an intermediate transfer belt 6, an intermediate transfer roller 7, and a transfer roller 8.

The photosensitive drum 1, which is as an example of a photosensitive member on which an electrostatic latent image is formed, may include a conductive metal pipe and a photosensitive layer formed on a periphery thereof. The charging roller 2 is an example of a charger that supplies electric charges and charges an outer circumferential surface of the photosensitive drum 1 with a uniform potential while rotating in contact or non-contact with the outer circumferential surface of the photosensitive drum 1. Instead of the charging roller 2, a corona discharger (not shown) may be employed. The exposure device 3 forms an electrostatic latent image by scanning light corresponding to image information onto the charged photosensitive drum 1 charged to a uniform potential. As the exposure device 3, a laser scanning unit (LSU) using a laser diode as a light source and an LED exposure device using a light emitting diode (LED) as the light source may be employed.

The printing unit 100 of the present example uses toners of cyan C, magenta M, yellow Y, and black B colors for printing a color image. Hereinafter, to distinguish each constituent element according to its color, the constituent elements are respectively identified by Y, M, C, and K.

The developing device 4 may include four developing devices 4Y, 4M, 4C, and 4K that supply and develop toners of yellow (Y), magenta (M), cyan (C), and black (K) to the electrostatic latent image formed on the photosensitive drum 1. Each of the developing devices 4Y, 4M, 4C, and 4K has a developing roller 5. The developing devices 4Y, 4M, 4C and 4K may be positioned such that the developing roller 5 is spaced apart from the photosensitive drum 1 by a developing gap. The developing gap may be about tens to hundreds of micrometers. In a multipass color printer, the plurality of developing devices 4 operates sequentially. A developing bias voltage is applied to the developing roller 5 of one selected developing device (for example, 4Y) and no developing bias voltage may be applied to the developing rollers 5 of the remaining developing devices (for example, 4M, 4C, and 4K) or a developing prevention bias voltage for preventing developing of the toner may be applied to the developing rollers 5 of the remaining developing devices (for example, 4M, 4C, and 4K). Only the developing roller 5 of the selected developing device (for example, 4Y) rotates and the developing rollers 5 of the remaining developing device (for example, 4M, 4C, and 4K) may not rotate.

The intermediate transfer belt 6 is supported by support rollers 61 and 62 and travels at a linear velocity substantially equal to the rotation linear velocity of the photosensitive drum 1. The length of the intermediate transfer belt 6 may be the same as or greater than the length of the printing medium P of the maximum size used in an image forming apparatus. The intermediate transfer roller 7 faces the photosensitive drum 1 and receives an intermediate transfer bias voltage for transferring the toner image developed on the photosensitive drum 1 to the intermediate transfer belt 6. The transfer roller 8 faces the intermediate transfer belt 6. The transfer roller 8 is spaced from the intermediate transfer belt 6 while the toner image is being transferred from the photosensitive drum 1 to the intermediate transfer belt 6, and when the toner image is completely transferred to the intermediate transfer belt 6, the transfer roller is in contact with the intermediate transfer belt 6 at a predetermined pressure. A transfer bias transfer for transferring the toner image to the printing medium P is applied to the transfer roller 8. A cleaning means 10 removes the toner remaining on the photosensitive drum 1 after the transferring of the toner image.

The fuser 200 may include a heating roller 210 and a pressing roller 220. The heating roller 210 is opposite an image surface of the printing medium P and applies heat to the toner image. To this end, the heating roller 210 is heated by a heat source 211. As the heat source 211, for example, a halogen lamp, a heating resistance coil, an induction heater, or a ceramic heater may be employed.

The pressing roller 220 forms a heating nip N together with the heating roller 210. An elastic layer (not shown) may be provided on an outer circumference of the pressing roller 220 to form a stable heating nip N.

In the present example, a belt 230 is interposed between the pressing roller 220 and the heating roller 210. The belt 230 is supported by the heating roller 210 and a support roller 240 and circulates. The printing medium P is supported by the belt 230 after passing through the heating nip N. Although not shown in the drawing, an endless belt that forms the heating nip N with the pressing roller 220 may be employed in place of the heating roller 210. The heat source 211 may heat the endless belt.

An image forming process according to the above configuration will be described below.

The photosensitive drum 1 charged with a uniform potential by the charging roller 2 is irradiated with light corresponding to image information of, for example, yellow (Y) color, from the exposure device 3. An electrostatic latent image corresponding to an image of yellow (Y) color is formed on the photosensitive drum 1. A developing bias voltage is applied to the developing roller 5 of the yellow developing device 4Y. Then, toner of yellow (Y) color is attached to the electrostatic latent image, and thus a toner image of yellow (Y) color is developed on the photosensitive drum 1. The toner image of yellow (Y) color is transferred to the intermediate transfer belt 6 by the intermediate transfer bias voltage applied to the intermediate transfer roller 7. When the transfer of the toner image of one page of yellow (Y) color is completed, the exposure device 3 irradiates the light corresponding to image information of, for example, magenta (M) color, to the photosensitive drum 1 recharged at a uniform potential by the charging roller 2 and forms an electrostatic latent image corresponding to an image of magenta (M) color. The magenta developing device 4M supplies and develops a toner of magenta (M) color to the electrostatic latent image. The toner image of magenta (M) color formed on the photosensitive drum 1 is transferred to the intermediate transfer belt 6 to overlap on the previously transferred toner image of yellow (Y) color. Upon performing the above-described process on cyan (C), and black (B) colors, a color toner image in which the toner images of yellow (Y), magenta (M), cyan (C), and black (B) colors overlap one another is formed on the intermediate transfer belt 6. The transfer roller 8 is brought into contact with the intermediate transfer belt 6. A pick-up roller 11 or 11*a* picks up the printing medium P from a paper feed cassette 103 (or a multipurpose tray 104). A conveying unit 12 conveys the printing medium P to the transfer nip N where the intermediate transfer belt 6 and the transfer roller 8 are opposite each other. The color toner image is transferred to the printing medium P that passed through the transfer nip N in response to the transfer bias voltage.

When the printing medium P passes the heating nip N of the fuser 200, the color toner image is fused to the printing medium P by heat and pressure. The printing medium P that passed through the fuser 200 is discharged to a discharge tray 101 by a discharge roller 13.

When the printing medium P on which fusing is completed is cooled, since glossiness of the fused toner image increases, an effect of a photographic image may be obtained. Also, the thermal stress accumulated in the printing medium P may be eliminated, to improve curling of the printing medium. To this end, the printer may include the vapor chamber 300 for cooling the printing medium P that passed through the fuser 200.

FIG. 3 is a perspective view of an example of a cooling structure for cooling the printing medium P. FIG. 4 is a cross-sectional view of an example of the vapor chamber 300. Referring to FIGS. 3 and 4, the vapor chamber 300 cools the printing medium P that passed through the fuser 200. The vapor chamber 300 may include a flat heat absorber (heat absorber side) 310 which is opposite the printing medium P and absorbs heat from the printing medium P, a condenser (condenser side) 320 which is spaced apart from the heat absorber 310 in an opposite direction to the printing medium P with an inner space 351 therebetween, and a working fluid 330 which is sealed in the inner space 351 and performs a liquid-vapor phase change between the heat absorber 310 and the condenser 320. The working fluid 330 may be, for example, water, alcohol, or the like. The vapor chamber 300 may be a thin hollow plate having a first length L1 longer than a width W1 of the printing medium P in a width direction W of the printing medium P. The width W1 of the printing medium P may be the maximum width of the printing medium that may be used in a printer. The length of a heat exchanger 350 of the vapor chamber 300 is substantially larger than the width W1 of the printing medium P as will be described later.

The inner space 351 is in a negative pressure state relative to the atmospheric pressure such that the working fluid 330 may be easily evaporated by heat. For example, the inner space 351 may be in a vacuum state. The heat absorber 310 may be opposite an image surface of the printing medium P, that is, a surface on which a toner image is formed, to cool the toner image quickly.

The vapor chamber 300 may have a second length L2 in a longitudinal direction L of the printing medium P, for example, in a conveying direction of the printing medium P, and a thickness L3. The thickness L3 is less than the second length L2. As a result, the vapor chamber 300 may have an overall thin hollow plate. The sectional shape of the vapor chamber 300 may be entirely rectangular as shown in FIG.

4. The heat absorber 310 may have a flat shape. Thereby, an opposite area of the printing medium P may be widened and thus the printing medium P may be quickly cooled. The condenser 320 may have a flat shape.

As an example, a capillary wick 340 may be provided in the inner space 351. The liquefied working fluid 330 flows from the condenser 320 to the heat absorber 310 directly across the inner space 351 or due to the capillary pressure along the capillary wick 340 as shown by a dotted line in FIG. 3. Although not shown in the drawings, the inner space 351 may be divided into a plurality of sub spaces. The capillary wick 340 may be provided along the edge of the inner space 351 and may be provided only on the heat absorber 310. The structure of the inner space 351 and the structure of the capillary wick 340 may vary.

The printing medium P that passed through the heating nip N is opposite the heat absorber 310. The heat absorber 310 is heated by the heat energy of the printing medium P. The working fluid 330 absorbs heat energy from the heat absorber 310, is evaporated and is changed into a vapor state. Vapor is moved toward the condenser 320 along the inner space 351. The vapor is deprived of the heat energy by the condenser 320, is condensed, and is thus changed into a liquid state. The working fluid 330 in the liquid state returns to the heat absorber 310. Thus, the working fluid 330 cools the printing medium P while undergoing a liquid-vapor phase change between the heat absorber 310 and the condenser 320.

Rapid cooling may improve glossiness of print medium. In addition, uniform cooling of the printing medium P in the width direction W and the longitudinal direction L may be needed.

In a heat pipe, a heat absorber and a condenser are spaced apart from each other in the width direction W of the printing medium P such that a working fluid in the heat pipe is moved in the width direction W of the printing medium P and conveys heat energy from the heat absorber to the condenser. In the heat pipe, the temperature of a part close to the condenser in the width direction W of the printing medium P is higher than the temperature of a part far from the condenser, and thus, the cooling performance of the part close to the condenser deteriorates. Therefore, uniform cooling may not be achieved in the width direction W of the printing medium P. When the printing medium P is unevenly cooled in the width direction W, the glossiness may be uneven in the width direction W, resulting in stained glossiness. Also, when the printing medium P is unevenly cooled in the width direction W, a curl in the width direction W may be generated in the printing medium P. As the printing speed increases, a heat pipe with a large cooling capacity is needed. When the cooling capacity of the heat pipe is insufficient, the printing medium P is unevenly cooled in the longitudinal direction L, the glossiness of the printing medium P may be uneven in the longitudinal direction L and the curl in the width direction W may be generated in the printing medium P.

According to the vapor chamber 300 of the present example, the heat absorber 310 and the condenser 320 are spaced apart from each other in the thickness direction. The working fluid 330 is directly moved in the thickness direction or is moved in the thickness direction by spreading in the width direction W and the longitudinal direction L along the inner space 351 to convey the heat energy from the heat absorber 310 to the condenser 320. Thus, the vapor chamber 300 may have uniform cooling performance in the width direction W of the printing medium P. Since the vapor chamber 300, unlike the heat pipe which has a one-directional heat transfer structure, has a two-directional heat transfer structure, the cooling uniformity may be achieved. Also, the vapor chamber 300 may accommodate more of the working fluid 330 than the heat pipe, and thus, a critical heat flux due to dryout is higher than that of the heat pipe. Also, since the condenser 320 and the heat absorber 310 are closer to each other compared to the heat pipe, a flow resistance of the vaporized working fluid 330 occurs for a very short period and the return path of the condensed working fluid 330 to the heat absorber 310 is short. Therefore, the printing medium P may be uniformly cooled in the width direction W and a printed image having uniform glossiness in the width direction W may be obtained. Also, curl occurrence in the width direction W of the printing medium P may be minimized, and the curl of the printing medium P generated in a fusing process may be improved.

Although not shown in the drawings, the printer may further include a finisher. The finisher may be mounted in the printer in a module form. In this case, the printing medium P on which printing is completed is sent to the finisher. The finisher may include an aligner aligning the printing medium P on which an image is printed and discharged. The aligner may have a structure capable of stapling a staple on the aligned printing medium P, a structure capable of perforating the aligned printing medium P, or the like. The finisher may include a paper folder folding the printing medium P at least one time. The curl of the printing medium P may affect the operational reliability of the finisher. According to the printer of the present example, since the curl generated in the fusing process may be improved by employing the vapor chamber 300 and cooling the printing medium P, the operational reliability of the finisher may be secured.

According to the vapor chamber 300 of the present example, since the working fluid 330 is moved in the thickness direction, it is possible to obtain a fast cooling speed and a large cooling capacity, and thus it is possible to achieve a high printing speed. Further, since the flat heat absorber 310 may have a large area opposite the printing medium P, the cooling speed and the cooling capacity may be further increased.

In the above example, although the vapor chamber 300 is disposed adjacent to the heating roller 210 of the fuser 200, a conveying roller (not shown) for conveying the printing medium P is disposed near an outlet of the fuser 200, the vapor chamber 300 may be disposed at the outlet of the conveying roller.

The heat absorber 310 of the vapor chamber 300 may be in direct contact with the belt 230 and a metal heat transfer member (not shown) having a small frictional resistance with the belt 230 may be interposed between the belt 230 and the heat absorber 310. In this case, grease may be applied between the heat transfer member and the belt 230 to reduce friction. A contact surface of the metal heat transfer member (not shown) in contact with the belt 230 may be coated with a friction reducing layer. The friction reducing layer may be, for example, a fluorine resin layer.

In a structure to form the heating nip N without using the belt 230 by directly contacting the heating roller 210 with the pressing roller 220, the heat absorber 310 of the vapor chamber 300 may be in direct contact with the printing medium P, and a metal heat transfer member (not shown) having a small frictional resistance with the printing medium P may be interposed between the printing medium P and the heat absorber 310. In this case, to reduce the friction between the heat transfer member and the printing medium P, a contact surface of the metal heat transfer member (not shown) in contact with the printing medium P may be coated with a friction reducing layer. The friction reducing layer may be, for example, a fluorine resin layer.

A heat dissipation structure for cooling the condenser 320 may be employed in the printer. Examples of the heat dissipation structure will be described below.

Referring to FIG. 3, the vapor chamber 300 may include the heat exchanger 350 corresponding to the width W1 of the printing medium P and a heat dissipater 360 extending from the heat exchanger 350 to the outside of the width W1 of the printing medium P as an example of the heat dissipation structure. A first portion of the vapor chamber 300 including the heat absorber side 310 and the condenser side 320 may be the heat exchanger 350 to correspond to the width of the printing medium P, and a second portion of the vapor chamber 300 extending from the heat exchanger 350 may be the heat dissipater 360 to correspond to outside of the width of the printing medium P. Thus, the condenser 320 extends outside the width W1 of the printing medium P. The blower 400 supplies air to the heat dissipater 360 to cool the heat dissipater 360. Accordingly, the cooling performance of the vapor chamber 300 may be improved by cooling the condenser 320.

As an example of the heat dissipation structure, a heat sink 410 having at least one cooling fin 411 may be in contact with the heat dissipater 360. The blower 400 may supply air to the heat sink 410. The heat sink 410 may be in contact with a surface 361 of the heat dissipater 360 on the condenser 320 to improve the cooling efficiency of the condenser 320. The heat dissipation area of the heat dissipater 360 is enlarged by the heat sink 410, and thus the cooling performance of the vapor chamber 300 may be improved.

FIG. 3 shows the bended vapor chamber 300 having the heat dissipater 360 that bends and extends from the heat exchanger 350. Although not shown in the drawings, a straight vapor chamber having the heat dissipater 360 extending straight from the heat exchanger 350 may also be possible.

Although the vapor chamber 300 of the present example has a heat dissipater 360 extending from an end of the heat exchanger 350, the vapor chamber 300 may have a structure in which two heat dissipaters 360 respectively extend from both side ends of the heat exchanger 350. In this case, two heat sinks 410 that are respectively in contact with the two heat dissipaters 360 may be employed. Further, two blowers 400 respectively supplying air to the two heat dissipaters 360 may be employed.

As an example of the heat dissipation structure, a heat dissipation area of the heat dissipater 360 may be enlarged. FIG. 5 is a perspective view showing an example of a heat dissipation structure. Referring to FIG. 5, a length L4 of the heat dissipater 360 is longer than a length of the heat exchanger 350, that is, the second length L2, with respect to the longitudinal direction L of the printing medium P. Although the length L4 gradually increases as the distance from the heat exchanger 350 increases, as shown in a dotted line in FIG. 5, the heat dissipater 360 has the length L4 in entirety. The heat sink 410 having the cooling fin 411 may be in contact with the heat dissipater 360. The blower 400 may supply air to the heat sink 410. The heat sink 410 may be in contact with the surface 361 of the heat dissipater 360 of the condenser 320 to improve the cooling efficiency of the condenser 320.

As an example of a heat dissipation structure, the heat dissipater 360 may include two or more heat dissipaters diverging from the heat exchanger 350. FIG. 6 is a perspective view showing an example of a heat dissipation structure. Referring to FIG. 6, the heat dissipater 360 may include heat dissipaters 360-1 and 360-2 diverging from the heat exchanger 350. The sum of lengths L41 and L42 of the heat dissipaters 360-1 and 360-2 is longer than the length L2 of the heat exchanger 350. The heat sink 410 having the cooling fin 411 may be in contact with the heat dissipaters 360-1 and 360-2. The blower 400 may supply air to the heat sink 410. To improve the cooling efficiency of the condenser 320, the heat sink 410 may be in contact with surfaces 361-1 and 361-2 of the condenser 320 of the heat dissipaters 360-1 and 360-2.

Accordingly, a heat dissipation area of the heat dissipater 360 is widened, and thus the condenser 320 may be effectively cooled. Since a region 360-3 between the heat dissipaters 360-1 and 360-2 serves as a passage for air supplied by the blower 400, the blowing resistance may be reduced and thus the cooling efficiency may be improved.

A heat dissipation structure supplying air directly to the condenser 320 may be also used. FIG. 7 is a perspective view showing an example of a heat dissipation structure. Referring to FIG. 7, a duct 420 forms an air passage in the width direction W of the printing medium P on the condenser side 320. The duct 420 may extend in the width direction W of the printing medium P and may be formed over the entire width W1 of the printing medium P. As an example, the condenser 320 may form one surface of the duct 420. As an example, a surface of the duct 420 may be in contact with the condenser 320. The blower 400 supplies air to the duct 420. Accordingly, since forced air may be blown to the condenser 320 through the duct 420, the cooling performance of the vapor chamber 300 may be improved by effectively cooling the condenser 320.

FIG. 8 is a perspective view showing an example of a heat dissipation structure. Referring to FIG. 8, a heat sink 430 having at least one cooling fin 431 is installed in the duct 420. The cooling fins 431 extend in the width direction W of the printing medium P. The plurality of cooling fins 431 may be arranged in the longitudinal direction L of the printing medium P. The heat sink 430 is in contact with the condenser 320. The heat sink 430 having the cooling fin 431 expands a heat dissipation area of the condenser 320. Therefore, the condenser 320 may be effectively cooled.

FIG. 9 is a side view of an example of a cooling structure for cooling the printing medium P. Referring to FIG. 9, a thermoelectric cooling element 440 is interposed between the printing medium P and the heat absorber 310 of the vapor chamber 300. The thermoelectric cooling element 440 is a cooler using the Peltier effect and may be formed by using a pn junction semiconductor. The thermoelectric cooling element 440 may adjust an amount of heat absorption according to an intensity of a supplied current.

The thermoelectric cooling element 440 is interposed between the vapor chamber 300 and the printing medium P to pump heat from the printing medium P to the vapor chamber 300. The thermoelectric cooling element 440 has a heat absorbing side 441 opposite the printing medium P and a heat dissipation side 442 opposite the heat absorber 310 of the vapor chamber 300. The heat dissipation side 442 of the thermoelectric cooling element 440 may be in contact with the heat absorber 310 of the vapor chamber 300. Accordingly, the thermoelectric cooling element 440 functions as a heat pump that absorbs heat energy from the printing medium P and transfers the heat energy to the heat absorber 310. The printing medium P may be uniformly and quickly cooled by employing the thermoelectric cooling element 440 that transfers heat from the printing medium P together with the vapor chamber 300.

The structure of the vapor chamber 300 may be the same as that shown in FIG. 4. Examples of the heat dissipation structures shown in FIGS. 3 to 6 may be applied to an example of the cooling structure shown in FIG. 9. As shown in FIG. 3, the vapor chamber 300 may include the heat exchanger 350 corresponding to the width W1 of the printing medium P and the heat dissipater 360 extending from the heat exchanger 350 to the outside of the width W1 of the printing medium P. The blower 400 may supply air to the heat dissipater 360. The heat sink 410 having the at least one cooling fin 411 is in contact with the heat dissipater 360. The blower 400 may supply air to the heat sink 410. The heat dissipater 360 may have the length L4 that is longer than the second length L2 of the heat exchanger 350 and include the diverging heat dissipaters 360-1 and 360-2 diverged from the heat exchanger 350. The printing medium P may be uniformly and quickly cooled by a combination of the heat pumping of the thermoelectric cooling element 440 and the structure of cooling the condenser 320 through the heat dissipater 360.

The examples of the heat dissipation structures shown in FIGS. 7 and 8 may be applied to the example of the cooling structure shown in FIG. 9. FIG. 10 is a side view of an example of a cooling structure for cooling the printing medium P. Referring to FIG. 10, the thermoelectric cooling element 440 is interposed between the printing medium P and the heat absorber 310 of the vapor chamber 300. The duct 420 forms an air passage in the width direction W of the printing medium P on the condenser 320. The printing medium P may be uniformly and rapidly cooled by a combination of the heat pumping of the thermoelectric cooling element 440 and a structure of cooling the condenser 320 by forced air blow through the duct 420.

The heat sink 430 having the at least one cooling fin 431 in the duct 420 may be installed in contact with the condenser 320. The plurality of cooling fins 431 may extend in the width direction W of the printing medium P and be arranged in the longitudinal direction L of the printing medium P. The printing medium P may be uniformly and rapidly cooled by a combination of the heat pumping of the thermoelectric cooling element 440, a structure for enlarging a heat dissipation area of the condenser 320 by applying the heat sink 430, and a structure for cooling the condenser 320 by forced air blow through the duct 420.

The above-described examples have been described with respect to the straight and bended vapor chambers 300. However, the vapor chamber 300 may have a different shape.

For example, the vapor chamber 300 may be U-shaped as shown in FIG. 11, but may also have various shapes according to an area and a length needed for cooling. The examples of the heat dissipation structures and the cooling structures shown in FIGS. 3 to 10 may also be applied to the U-shaped vapor chamber 300 as shown in FIG. 11.

The printer may be an ink-jet printer having the printing unit 100 that forms an image on the printing medium P by using an ink-jet method. FIG. 12 is a schematic configuration diagram of an example of an ink jet printer. Referring to FIG. 12, the printing unit 100 of the present example forms an image by ejecting a liquid, for example, ink, onto the printing medium P. The printing unit 100 may include an inkjet head 110. The inkjet head 110 may be a shuttle type inkjet head that discharges ink onto the printing medium P which is moved in a sub scanning direction while reciprocating in a main scanning direction. The inkjet head 110 may be an array inkjet head which has a length in the main scanning direction corresponding to a width of the printing medium P and discharges ink onto the printing medium P moved in the sub scanning direction from a fixed position without moving in the main scanning direction. By employing the array inkjet head, high-speed printing is possible as compared with the case of employing the shuttle type inkjet head. The inkjet head 110 may be, for example, a monochrome inkjet head ejecting black ink. The inkjet head 110 may be a color inkjet head that ejects ink of, for example, black (K), yellow (Y), magenta (M), and cyan (C) colors.

The printing medium P is supported on a platen 120 to be spaced apart by a predetermined space from the inkjet head 110. The inkjet head 110 ejects ink onto the printing medium P to form an image. The fuser 200 applies heat and pressure to the printing medium P on which the image is formed to fuse the image on the printing medium P. The fuser 200 may completely remove moisture from the printing medium P to lower a surface roughness of the printing medium P. Although not shown in the drawings, a blowing type dryer drying the ink on the printing medium P may be positioned between the printing unit 100 and the fuser 200. The fuser 200 may have various structures. For example, the structure of the fuser 200 may include a heating roller and a pressing roller that are engaged with each other to form a heating nip, a heating roller and a pressing roller that are pressed against each other with a belt therebetween, an endless belt and a pressing roller that are engaged with each other to form a heating nip, or the like.

In the case of an inkjet printer, curl of the printing medium P that may be generated in a fusing process may be improved by cooling the printing medium P that passed through the fuser 200. The vapor chamber 300 cools the printing medium P that passed through the fuser 200. The structure of the vapor chamber 300 may be the same as that shown in FIG. 4. The vapor chamber 300 may be opposite an image surface of the printing medium P. The examples of the heat dissipation structures shown in FIGS. 3 and 5 to 10 and the examples of the cooling structure and the U-shaped vapor chamber 300 shown in FIG. 11 may also be applied to the inkjet printer shown in FIG. 12.

While examples have been described with reference to the figures, it will be understood by those of ordinary skill in the art that various changes in form and details may be made therein without departing from the spirit and scope as defined by the following claims.

The invention claimed is:

1. A printer comprising:

a printing unit to form a toner image on a printing medium;

a fuser to apply heat to the printing medium that has passed through the printing unit, to fuse the toner image on the printing medium; and a liquid-vapor chamber extending at length in a width direction of the printing medium, the length greater than a width of the printing medium, the liquid-vapor chamber having a heat exchanger portion to correspond to at least the width of the printing medium, the heat exchanger portion including a heat absorber side extending in the width direction of the printing medium to correspond to at least the width of the printing medium and to face the printing medium to absorb heat from the printing medium, a condenser side apart from the heat absorber side in an opposite direction away from the printing medium and extending in the width direction of the printing medium to correspond to at least the heat absorber side, to form an inner space of the liquid-vapor chamber between the condenser side and the heat absorber side, and a working fluid sealed in the inner space to undergo a liquid-vapor phase change by moving between the heat absorber side and the condenser side, to absorb heat from the printing medium to cool the printing medium that has passed through the fuser.

2. The printer of claim 1, wherein the liquid-vapor chamber further includes a heat dissipater portion extending from the heat exchanger portion, and the printer comprises a blower to supply air to the heat dissipater portion.

3. The printer of claim 2, further comprising:

a heat sink in contact with the heat dissipater portion and having at least one cooling fin, wherein the blower is to supply air to the heat sink.

4. The printer of claim 3, wherein a length of the heat dissipater portion along a longitudinal direction of the printing medium is greater than a length of the heat exchanger portion along the longitudinal direction of the printing medium.

5. The printer of claim 3, wherein the heat dissipater portion comprises two or more heat dissipater portions diverging from the heat exchanger portion.

6. The printer of to claim 1, further comprising:

a duct forming an air passage in the width direction of the printing medium on the condenser side; and a blower to supply air to the duct.

7. The printer of claim 6, further comprising:

a heat sink installed in the duct and in contact with the condenser side, the heat sink comprising at least one cooling fin.

8. The printer of claim 1, further comprising:

a thermoelectric cooling element interposed between the printing medium and the heat absorber side, to transfer heat from the printing medium to the heat absorber side.

9. The printer of claim 8, wherein the liquid-vapor chamber further includes a heat dissipater portion extending from the heat exchanger portion, and the printer comprises:

a heat sink in contact with the heat dissipater portion, the heat sink comprising at least one cooling fin; and a blower to supply air to the heat sink.

10. The printer of claim 8, further comprising:

a duct forming an air passage in the width direction of the printing medium on the condenser side; and a blower to supply air to the duct.

11. The printer of claim 10, further comprising:

a heat sink installed in the duct in contact with the condenser side, the heat sink comprising at least one cooling fin.

12. A printer comprising:

a printing unit to form an image on a printing medium;

a fuser to apply heat to the printing medium that passed through the printing unit, to fuse the image on the printing medium; and a liquid-vapor chamber to include a working fluid sealed in an inner space of the liquid-vapor chamber, the working fluid to undergo a liquid-vapor phase change in the inner space by moving between a first side of the liquid-vapor chamber and a second side of the liquid-vapor chamber apart from the first side by a thickness of the liquid-vapor chamber, to cool the printing medium that passed through the fuser, wherein the liquid-vapor chamber has a first length in a width direction of the printing medium, a second length in a longitudinal direction of the printing medium, and the thickness, wherein the first length is greater than a width of the printing medium, and the thickness is thinner than the second length.

13. The printer of claim 12, wherein the liquid-vapor chamber comprises:

a heat exchanger portion to correspond to the width of the printing medium, and a heat dissipater portion extending from the heat exchanger portions, and the printer further comprises:

a heat sink in contact with the heat dissipater portion, the heat sink comprising at least one cooling fin; and a blower to supply air to the heat sink.

14. The printer of claim 12, wherein the liquid-vapor chamber comprises a heat absorber side being the first side facing the printing medium, and a condenser side being the second side apart from the heat absorber side in an opposite direction away from the printing medium and forming the inner space between the condenser side and the heat absorber side, and the printer further comprises:

a duct forming an air passage in the width direction of the printing medium on the condenser side;

a heat sink installed in the duct in contact with the condenser side and comprising at least one cooling fin; and a blower to supply air to the duct.

15. The printer of claim 12, further comprising:

a thermoelectric cooling element interposed between the liquid-vapor chamber and the printing medium to transfer heat from the printing medium to the liquid-vapor chamber.

* * * * *